United States Patent [19]

Hoskinson et al.

[11] 4,205,574

[45] Jun. 3, 1980

[54] ELECTRONIC MUSICAL INSTRUMENT WITH VARIABLE PULSE PRODUCING SYSTEM

[75] Inventors: William R. Hoskinson, Geneva, Ill.; Peter E. Solender, Williamsville, N.Y.

[73] Assignee: The Wurlitzer Company, DeKalb, Ill.

[21] Appl. No.: 873,011

[22] Filed: Jan. 27, 1978

[51] Int. Cl.[2] ..... G10H 1/06; G10H 5/06

[52] U.S. Cl. ..... 84/1.01; 84/1.03; 84/1.19; 84/1.24; 84/DIG. 11

[58] Field of Search ..... 84/1.01, 1.03, 1.19, 84/1.20, 1.21, 1.22, 1.23, 1.24, DIG. 9, DIG. 11, DIG. 23

[56] References Cited

U.S. PATENT DOCUMENTS

| | | | |
|---|---|---|---|
| 3,743,756 | 7/1973 | Franssen | 84/DIG. 11 |
| 3,894,463 | 7/1975 | Rocheleau | 84/1.19 |
| 3,972,259 | 8/1976 | Deutsch | 84/1.24 |
| 4,055,103 | 10/1977 | Machanian | 84/DIG. 11 |
| 4,077,294 | 3/1978 | Hiyochi | 84/1.23 |
| 4,137,810 | 2/1979 | Wheelwright | 84/1.03 |

*Primary Examiner*—J. V. Truhe
*Assistant Examiner*—William L. Feeney
*Attorney, Agent, or Firm*—Trexler, Wolters, Bushnell & Fosse

[57] ABSTRACT

An electronic musical instrument develops digital pulses corresponding to electronic waves that are subsequently converted to audio sound such as by means of a loudspeaker. The musical instrument is provided a source of master frequency generated binary related numbers which act in conjunction with a read only memory, an adder, and a comparator, and also a counter, to control a J/K flip-flop to produce a pulse train output in which for any given cycle the starting time and duration of each pulse is controlled, thereby to determine the harmonic content of the electronic waves that are converted to audio sound.

27 Claims, 11 Drawing Figures

ELECTRONIC MUSICAL INSTRUMENT WITH VARIABLE PULSE PRODUCING SYSTEM

BACKGROUND OF THE INVENTION

Electronic organs have been known for many years and for most of the that time have used analog tone generators of one sort or another. In so called additive or synthesizing organs it has been the practice to add together a large number of harmonically related sine waves to produce resultant complex waves. In the so called formant type of organ complex waves have been generated which have thereafter been filtered to remove undesired harmonic and inharmonic partials, and thereby to simulate a desired wave form.

In more recent years the patent art is replete with disclosures of digital organs in which computer techniques are utilized to generate or establish desired wave forms.

SUMMARY AND OBJECTS OF THE PRESENT INVENTION

It is known that a square wave with a 50% duty cycle produces only the odd harmonics. It is also known that a rectangular wave with a one-eighth duty cycle produces a tone simulating a piano. It readily follows that different duty cycles produce different harmonic structures and output tones. It can be demonstrated mathematically that any desired wave form can be developed from a rectangular or pulse wave by varying the start and the duration or each pulse in a plurality of fixed positions per cycle. It is an object of this invention to utilize this knowledge in a practical structure for producing a desired wave shape.

In particular, it is an object of this invention to provide means for generating a pulse train having a variable number of pulses per cycle, and with means for varying the starting time and duration of the pulses in accordance with a predetermined pattern to produce a desired time varying harmonic content.

Specifically, in connection with the present invention a pulse train as set forth heretofore is generated in which binary related numbers are fed in parallel and are combined with a read only memory and an adder to a comparator for varying the starting time and the duration of pulses in each cycle in accordance with the information stored in the read only memory.

DRAWING DESCRIPTION

The invention will best be understood with reference to the following text and accompanying drawings wherein.

Figure 4:
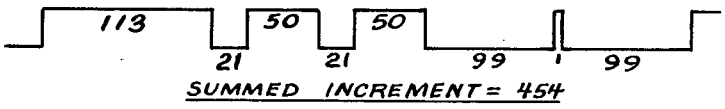
Figure 5:
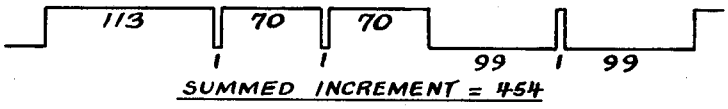
Figure 3:
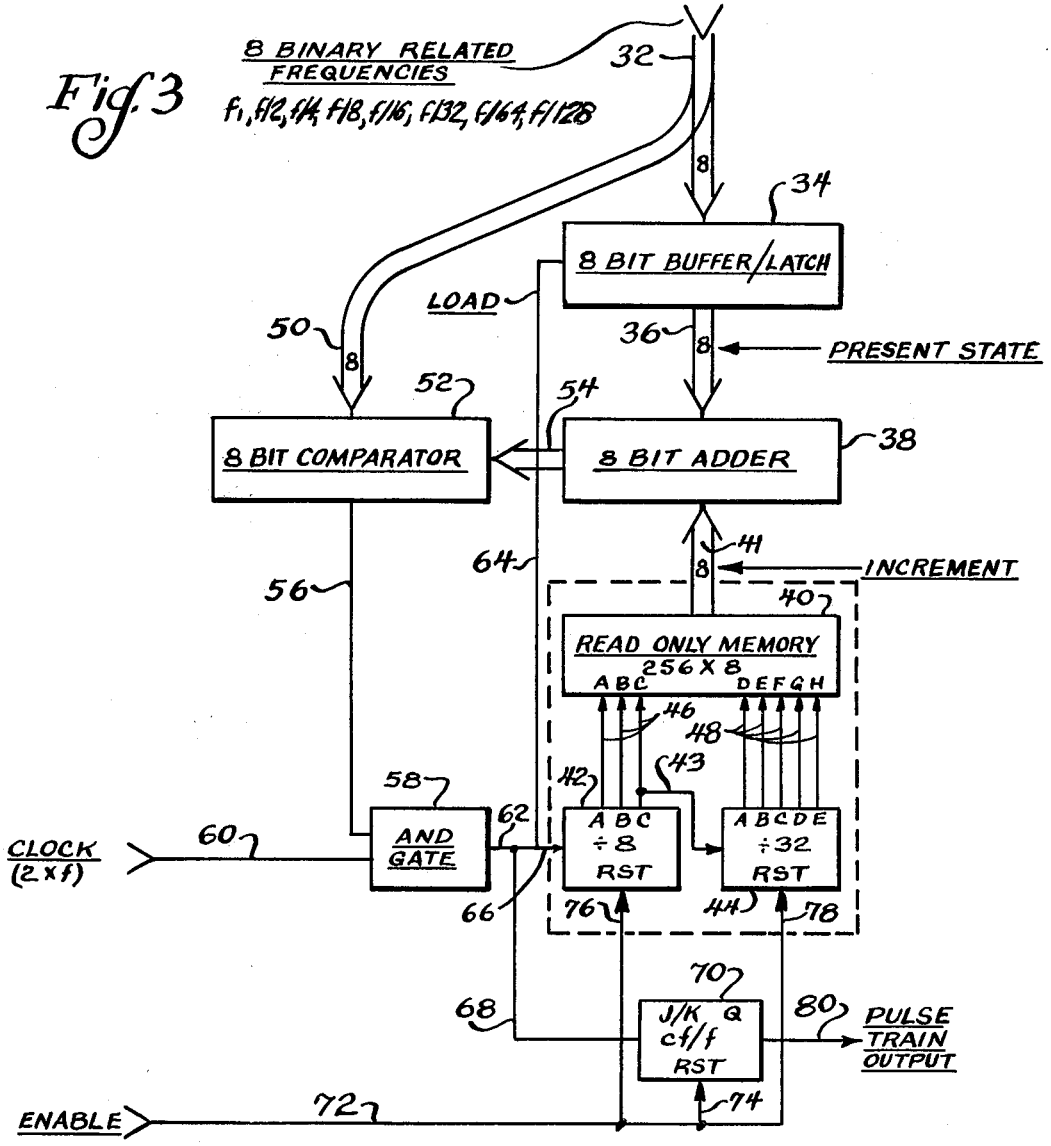
Figure 6:
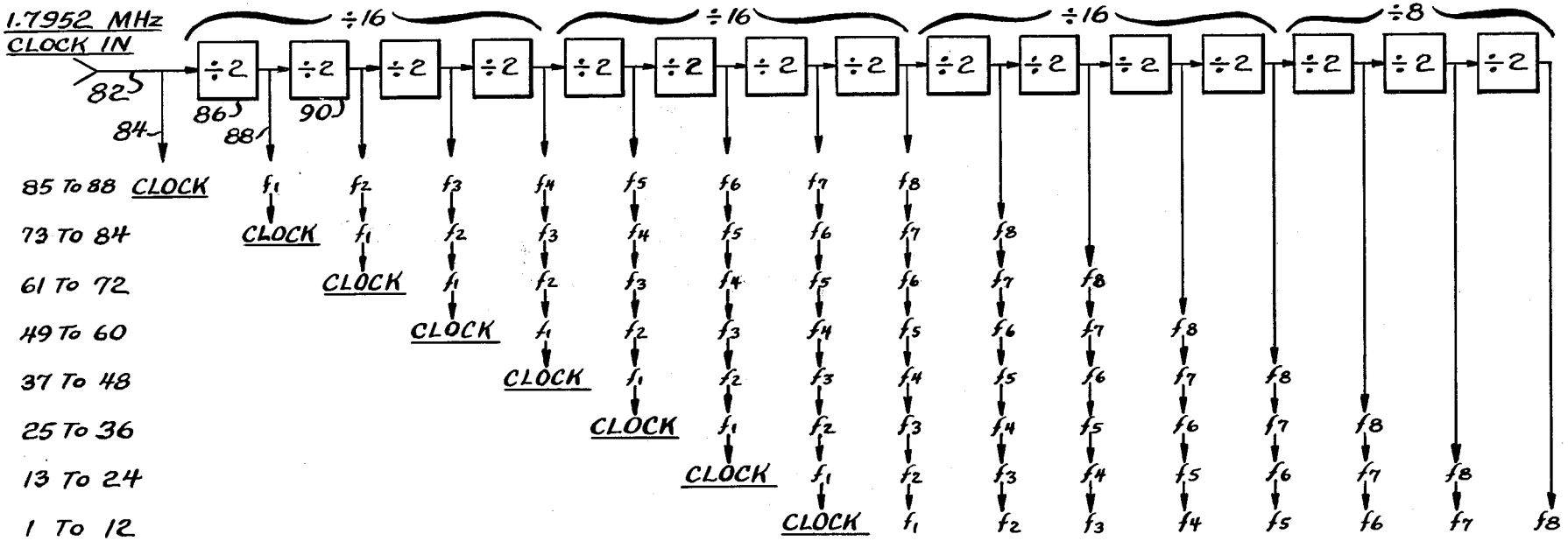
Figure 8:
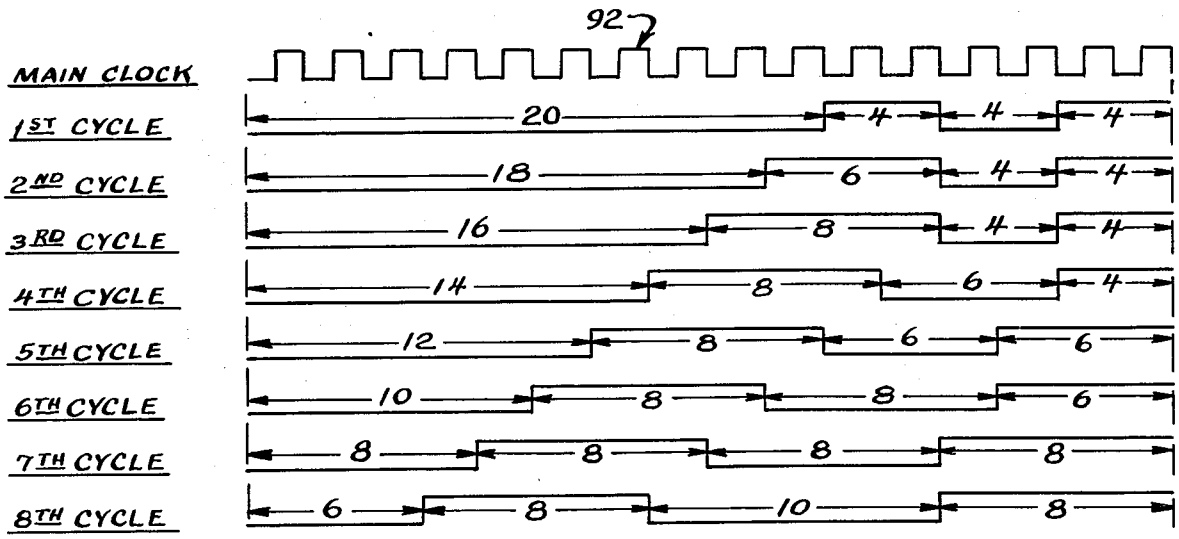
Figure 7:
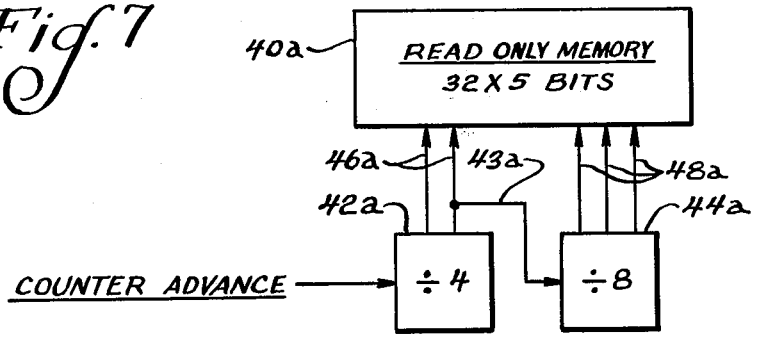
Figure 9:
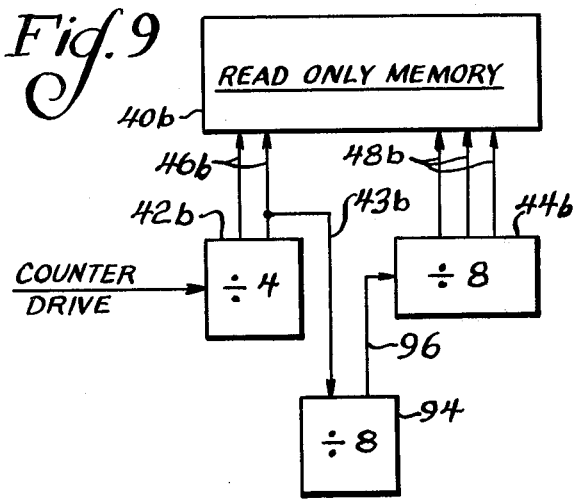
Figure 10:
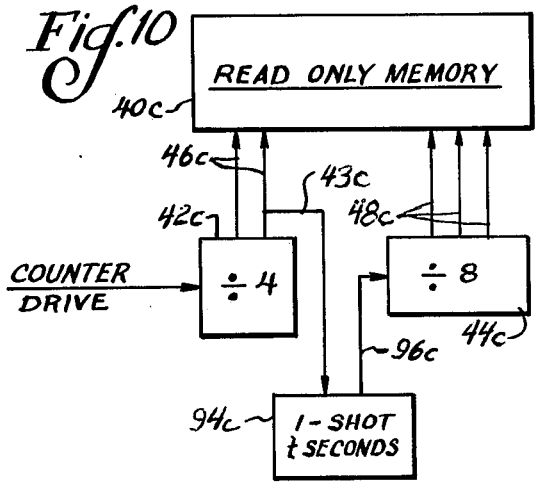
Figure 11:
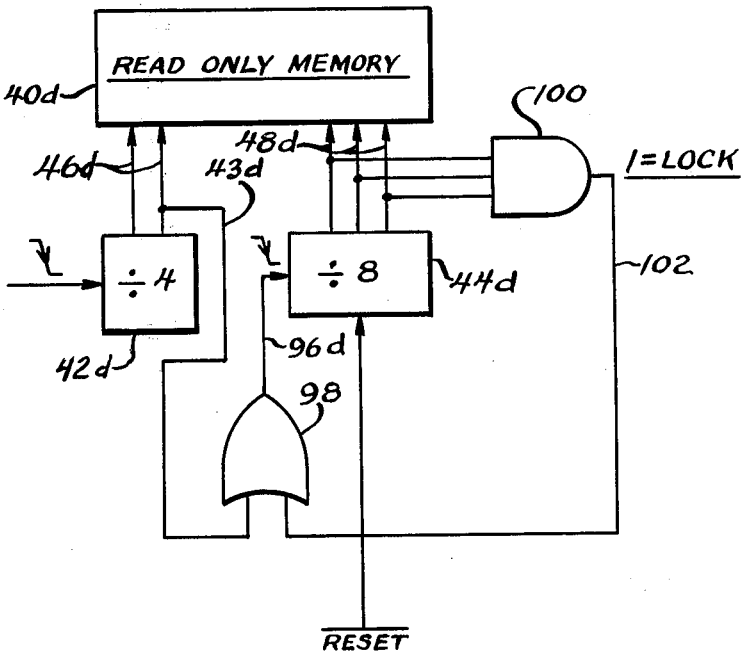

FIG. 3 comprises a block diagram of the pulse producing system of the present invention;

FIG. 4 is a wave form of an exemplary frequency at the start of generation of such frequency;

FIG. 5 is similar to FIG. 4 but showing the same note for example at the end of the time variation period;

FIG. 6 comprises a primarily block diagram illustrating the useage of a common counter to develop blocks of N-bit numbers for use by the control circuits of each octave;

FIG. 7 is a simplified portion of the ROM and the counter advance and divisors for control of the ROM;

FIG. 8 shows a simplified example of pulse formation vs. master clock frequency;

FIGS. 9 and 10 are block diagrams showing further control of the time variation of spectral content of the pulse wave developed in accordance with the present invention and FIG. 11 is a block diagram showing a variation in which a time varying spectral content is to be used for only a portion of the note play length.

DETAILED DESCRIPTION

Figure 1:
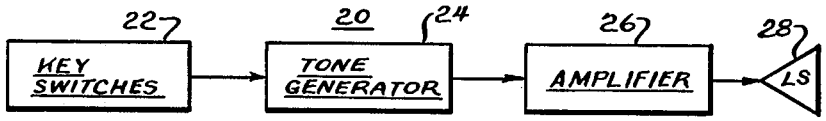
FIG. 1 is a block diagram of an electronic musical instrument constructed in accordance with the present invention.

Referring now in greater particularity to the drawings, and first to FIG. 1, there will be seen a block diagram of an electronic musical instrument generally designated 20. This musical instrument includes a plurality of key switches 22. In the case of an electronic organ it will be understood that the key switches also generally include switches to be operated by the feet through the use of pedals or pedal keys. In the present invention the harmonic structure is designed to change markedly with time, and this particularly exemplifies the tone of a piano. A piano, of course, conventionally has only one keyboard rather than the two keyboards and pedalboard of an organ. The key switches 22 are in turn respectively suitably connected to tone generators 24 incorporating the novel aspects of the present invention. Tone generators are connected to an amplifier 26, and this in turn is connected to a loudspeaker 28 for converting electronic oscillations into audible sound.

For the sake of exemplification of the present invention a wave form 30 (FIG. 2) comprises four pulses to one cycle of the wave form. The frequency of each note is of course determined by the duration of a cycle. In the present instance the harmonic structure of the wave form is determined by the time that each pulse starts within a cycle, and also the duration or length of the pulse.

Figure 2:
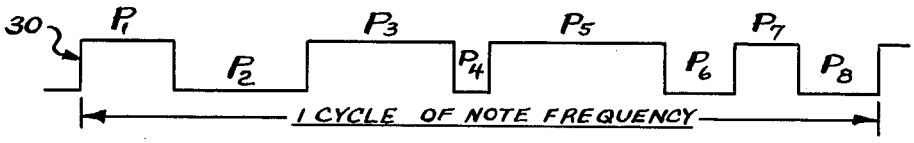
FIG. 2 shows the basic pulse pattern produced in accordance with the present invention.

In the example given in FIG. 2 there are four pulses per wave form. The pulses are produced by alternate transitions from 0 to 1 and from 1 to 0. Hence, there are 8 transitions and 8 sections to the pulse pattern respectively denoted by $P_1$ through $P_8$, respectively.

Attention now should be directed to FIG. 3 which comprises a block diagram of the pulse producing system for one note, there being one such system for each note. This system has similarities with copending application Ser. No. 758,598 filed Jan. 12, 1977 by Robert W. Wheelwright and Peter E. Solender, now U.S. Pat. No. 4,137,810 entitled "Digitally Encoded Top Octave Generator" and assigned to the same assignee as the present application, namely The Wurlitzer Company. That disclosure is incorporated herein by reference. Eight related binary counter outputs are supplied in parallel at 32 from a counter. The source of these binary numbers will be set forth in some detail later. Note that at any given instant of time the eight counter outputs are an eight-bit number, but in on going time they are also frequencies, and these frequencies, as shown in FIG. 3 comprise f, f/2, f/4, f/8, f/16, f/32, f/64 and f/128.

The eight binary related frequencies are applied to an eight bit buffer/latch 34 which has eight parallel outputs at 36 entered into an eight bit adder 38. The purpose of this latch is to "freeze" the on going frequencies at some defined point as an 8-bit word.

The circuit also includes a 256×8 bit ROM (read only memory) 40 which provides an 8 bit binary word output, i.e., 8 parallel binary outputs at 41 to the 8 bit adder 38. The binary number from the ROM specifies the increment (or time interval) before the next transition of the wave form. (These increments correspond to the time periods $P_1$–$P_8$ in FIG. 2 and are equal to the stored number.) The sum of these increments must total the period of one cycle of the note frequency. Thus $f$ out$=(P_1+P_2+P_3+\ldots+P_n)/f$.

Control for the ROM is provided by a divide-by-eight circuit 42 having the final output thereof fed at 43 to a divide-by-thirty-two circuit 44. (It will be appreciated that each of the blocks or black boxes in FIG. 3 comprises a commercially available integrated circuit chip, and exemplary types will be set forth hereinafter.) The three outputs of the divide-by-eight circuit identified in common by numeral 46 are connected to appropriate input terminals of the ROM 40. Similarly, the five outputs 48 of the divide-by-thirty-two circuits 44 are connected to respective appropriate inputs of the ROM 40.

The eight binary related frequencies at 32 are applied in parallel also at 50 to an eight bit comparator 52. An eight-bit number output from the eight bit adder 38 is applied at 54 to a second input of the eight bit comparator 52. The eight bit comparator is provided with an output line 56 which has a high or logical one output when the inputs 50 and 54 are identical. The output line is connected to an AND gate 58 having a clock input 60 at 2f. The 2f clock pulse is synchronous with the binary related frequencies and provides half-clock strobing of the various control elements. The AND gate has an output 62 which leads through a line 64 to the eight bit buffer/latch 34 to load the buffer when there is a one output from the AND gate. The output line 62 from the AND gate also is connected through an additional line 66 to the divide-by-eight circuit 42 to cause the latter to advance and present the next word to the read only memory when there is a one output from the AND gate. In addition, the output line 62 is connected to yet another line 68 leading to the clock or toggle input of a JK flip-flop 70.

An enable line 72 is connected to the reset terminal of the JK flip-flop 70 at 74, and also to the reset terminals 76 and 78 of the divide-by-eight and the divide-by-thirty-two circuits. This line allows the generator to be locked off and enabled (re-started) on command. The Q output of the JK flip-flop 70 comprises a line 80 which is either a one or a zero, depending upon the state of flipping or flopping of the JK flip-flop, the output on the line 80 comprising the desired pulse train output.

When the "present" state of the eight binary related input frequencies is loaded into the eight bit buffer/-latch 34 the increment or time interval to the next transition reads from the ROM 40 to produce an output from the adder 38 to the comparator 54. When a comparison is reached the AND gate 58 on the next 2f clock pulse produces an output at 62, whereby the JK flip-flop 70 changes state. At the same time the output from the AND gate 58 at 64 loads in a new "present" state to the eight bit buffer 34. Similarly, the divide-by-eight circuit 42 is moved to its next state by the AND gate output at 66. The divide-by-eight circuit will initially be set to 0 (when the enable is off) and as it goes through its eight states the increments $P_1$ through $P_8$ will be produced. The divide-by-thirty-two circuit following the divide-by-eight circuit allows 32 consecutive variations of the eight increments to be produced. This allows the waveform to change with time. It is to be understood that the divide-by-eight and divide-by-thirty-two circuits could be restructured to comprise a divide-by-sixteen and a divide-by-sixteen circuit to produce sixteen variations of an eight pulse train, or a divide-by-thirty-two and a divide-by-eight circuit to produce eight variations of a sixteen pulse train, etc.

The eight related binary frequencies at 32 may be produced by divide-by-sixteen circuits as will be pointed out hereinafter, each such divide-by-sixteen circuit comprising a commercially available 74193 chip. Similarly, the eight bit buffer is a commercially available chip number 8202. The eight bit adder comprises two four bit adders each a commercially available chip number 7483, interconnected in the usual manner to comprise an eight bit adder. The ROM 40 comprises a PROM (programmable read only memory) available commercially as chip number 5202 AQ, while the eight bit comparator 52 comprises two four bit comparator chips number 9324 connected in the usual manner. The AND gate 58 and the JK flip-flop 70 are well-known in the art, but for example may comprise commercial chips 7408 and 7473, respectively.

In order to determine the frequency relationships it must be recognized that at least two transitions are required to make up a frequency waveform. With an eight bit system as described herein there can be up to 256 increments per transition. Thus, the increments sum to a total of 512 increments to produce a frequency or cycle. It is desired for practical reasons to keep the upper frequency as low as possible. If the clock frequency can be held below two MHz the system is PMOS compatable. If 510 is chosen as the upper sum increment and the last octave of the keyboard starts at note 85, then the upper clock frequency can be determined. Note 85 is 3520 Hz in frequency, and the clock frequency therefore is 3520 Hz×510=1.7952 MHz.

Utilizing the aforesaid clock frequency, a chart relating notes 85 to 88 and the summed increments thereof is as follows:

| Summed Increment | Note Number |
|---|---|
| 510 | 85 |
| 481 | 86 |
| 454 | 87 |
| 429 | 88 |

If the same concepts are to be followed as to frequencies produced an octave below note 85, the clock frequency must also be reduced by a factor of 2. A corresponding chart showing summed increments for notes 73 to 84 based on a clock frequency of 1.7952/2=897.6 KHz is as follows:

| Summed Increment | Note Number |
|---|---|
| 510 | 73 |
| 481 | 74 |
| 454 | 75 |
| 429 | 76 |
| 405 | 77 |
| 382 | 78 |
| 361 | 79 |
| 340 | 80 |
| 321 | 81 |
| 303 | 82 |
| 286 | 83 |

-continued

| Summed Increment | Note Number |
|---|---|
| 270 | 84 |

The same list of summed increments can be used for each octave by dropping the clock frequency by a factor of two as the octaves go down the scale. A block diagram of a circuit producing all of the clock frequencies and binary frequencies for the 88 note system is shown in FIG. 6. This circuit comprises the clock in at 82, which comprises also the first clock frequency out at 84. The clock frequency at 82 is applied to divide-by-two circuit 86, which produces $f_1$ at 88. The output of the divide-by-two circuit 86 is also connected to another divide-by-two circuit 90, which is connected to further divide-by-two circuits seratim to a total of 15 divide-by-two circuits, all identical. Clock outputs and the respective frequencies for each octave are provided as shown.

There is one pulse producing system as in FIG. 3 for each frequency to be produced from the electronic musical instrument. The frequency of the clock, f, for the top octave is shown as the $f_1$ output at 88. The output at 84 comprises the $2\times f$ input at 60 in FIG. 3 for half clock strobing. F2 in the top line (notes 85–88) of FIG. 6 is f/2 of FIG. 3 etc.

Similarly for the second octave, notes 73–84 (second line of FIG. 6.) the $f_1$ is f of FIG. 3, while $f_2$ of FIG. 6 is f/2 of FIG. 3, etc.

In FIG. 2 an arbitrary pulse pattern for a single cycle of note frequency is shown. The construction of a particular illustrative note is shown in FIGS. 4 and 5. FIG. 4 illustrates the note at its inception, whereas FIG. 5 shows conclusion of the note after several changes over a period of time.

Specifically, in FIG. 4 there are four pulses shown with the increments for each illustrated. The pulses have been chosen to produce a certain harmonic response. The first pulse width is 113 increments out of a summed total of 454 increments, i.e., approximately a ¼ duty cycle.

The waveform in FIG. 5 is of the same frequency as FIG. 4, but changed with time as after 20 changes. The increments are stored in the ROM to be read out at different portions of the divide-by-eight decoded states. The first time span pulse remains at 113 increments. However, the second time span has been shortened to only one increment. The next pulse is at seventy increments. The remaining increments can readily be seen in FIG. 5 the same as in FIG. 4, whereby the pulse distribution readily can be seen to be substantially altered, thus resulting in a changed harmonic structure of the note produced, notwithstanding lack of change of the basic frequency of the note. It will be noted that the difference in the wave form is in the second and third pulses, i.e. $P_3$ and $P_5$ changing starting points and widening with time. The sequence of variation from FIG. 4 to FIG. 5 can occur in any desired manner. For example one or more pulses could narrow to zero, thus effectively reducing the number of pulses.

If it is desired that the frequencies across the scale should become slightly sharp as the note numbers are increased (scale stretching), the summed increments can be changed slightly. Since the summed increments are contained in read only memories, this is readily done.

Although it is believed that the invention is adequately disclosed up to this point it is felt that additional explanatory material as hereinafter set forth may be helpful. Thus, with reference to the ROM 40 in FIG. 3 and also to the divide-by-eight circuit 42 and the divide-by-thirty-two circuit 44, the output 41 of the ROM comprises data lines presenting an eight bit word for each address. The first three address lines from the divide-by-eight circuit are used to determine the numer of transitions per cycle. In the exemplary embodiment of the invention there are eight transitions per cycle, i.e. four pulses. The five address lines from the divide-by-thirty-two circuit are used to determine the number of variations of pulse width/position.

FIG. 7 is similar to a portion of FIG. 8, but somewhat simplified for illustration. In order that the correspondence in part might readily be evident, corresponding numerals are used with the addition of the suffix a. Thus, the ROM **40*a* is simplified to be only a 32 word by 5 bit ROM. Similarly, the first divider 42*a* comprises a divide-by-four circuit, while the second divider 44*a*** comprises a divide-by-eight circuit. Since there are now five bits per word, there are 32 possible increment points for transition. There are also 32 words which means 32 possible transitions. The counter is split to show four transitions per cycle and eight cycle patterns. The following chart shows each of the thirty-two words stored in the ROM word positions. Each word stored tells the interval or number of increments to the next transition. Each interval is up to the thirty-two countes of the master clock. This is any number from 1 to $2^N$, where N equals the number of bits per word (in the case N=5). This chart is as follows:

| | ROM COUNTER STATE | WORD STORED (Decimal Base) |
|---|---|---|
| 0 | 00000 | 20 |
| 1 | 10000 | 4 |
| 2 | 01000 | 4 |
| 3 | 11000 | 4 |
| 4 | 00100 | 18 |
| 5 | 10100 | 6 |
| 6 | 01100 | 4 |
| 7 | 11100 | 4 |
| 8 | 00010 | 16 |
| 9 | 10010 | 8 |
| 10 | 01010 | 4 |
| 11 | 11010 | 4 |
| 12 | 00110 | 14 |
| 13 | 10110 | 8 |
| 14 | 01110 | 6 |
| 15 | 11110 | 4 |
| 16 | 00001 | 12 |
| 17 | 10001 | 8 |
| 18 | 01001 | 6 |
| 19 | 11001 | 6 |
| 20 | 00101 | 10 |
| 21 | 10101 | 8 |
| 22 | 01101 | 8 |
| 23 | 11101 | 6 |
| 24 | 00011 | 8 |
| 25 | 10011 | 8 |
| 26 | 01011 | 8 |
| 27 | 11011 | 8 |
| 28 | 00111 | 6 |
| 29 | 10111 | 8 |
| 30 | 01111 | 10 |
| 31 | 11111 | 8 |

The eight possible cycle patterns from the chart above are shown in FIG. 8. Thus, the main clock waveform is shown at 92. In the first cycle under this waveform we see that the first period is 20 transitions of the main clock, corresponding to "word stored" 20 opposite word zero. There are four counter transitions in the next pulse, followed by two more four counter transitions to complete the first cycle.

The second cycle then takes over with 18 transitions, as corresponds with "word stored" 18 opposite word four in the foregoing chart. The remainder of FIG. 8 is believed to be self-explanatory.

Further control of the time variation of spectral content of the wave is illustrated in FIGS. 9 and 10. In FIG. 9 parts corresponding to the parts of FIG. 3 and 7 are identified by similar numerals with the addition of the suffix b, while in FIG. 10 similar parts have similar numerals with the addition of the suffix c.

FIG. 9 is distinguished in that line **43*b* leads to a divide-by-eight circuit 94, which in turn is connected by an output line 96 to the previous divide-by-eight circuit 44*b*. Addition of the divide-by-eight circuit 94** causes production of eight cycles of each type to be played.

FIG. 10 again is similar, with line **43*c* leading to a one shot circuit 94*c* of t seconds duration. The output from the one shot 94*c* leads through a line 96*c* of the divide-by-eight circuit 44*c*. This produces t seconds of each type cycle to be played. In other words, in FIG. 9 the repetition of a cycle continues for eight cycles regardless of time and is synchronous while in FIG. 10** each cycle is continued for t seconds regardless of how many repetitions this may comprise and is asynchronous.

Further control is shown in FIG. 11, various parts again corresponding to FIG. 7, and similar numerals being used, this time with the addition of the suffix d.

FIG. 11 distinguishing features includes more substitution of an OR gate 98, with the lead **43*d* comprising one input to the OR gate. A 3-input AND gate 100 has its input connected to the lines 48*d*. When all three of the inputs are high the AND gate 100 has a one output which is connected through a line 102 to the second input of the OR gate 98. In this circuit the time varying spectral content is used for only a portion of the note play length. Thus, the OR gate 98 serves as a blocking gate for the second portion of the ROM counter. In the circuit of FIG. 11 there is a time variation of harmonics followed by a long sustain on, for example, the eighth pattern. The divide-by-eight 44*d* locks on the last pattern until reset. The output of the OR gate 98 stops high and the divide-by-eight circuit 44*d*** will not advance except on a negative during transition. As is known, typical TTL counters trigger on the negative edge, while CMOS circuits trigger in the positive going edge.

The foregoing specific examples of the invention are by way of illustration only. Various changes in structure will no doubt occur to those skilled in the art, and will be understood as forming a part of the present invention insofar as they fall within the spirit and scope of the appended claims.

The invention is claimed as follows:

1. A tone generating circuit for an electronic musical instrument, comprising means for providing a sequence of digital numbers, means connected to said number providing means for retaining selected ones of said numbers, number comparing means connected to said number providing means, a memory having a plurality of digital numbers stored therein, an adder, control means connected to said memory and effective to cause said memory to present a second sequence of digital numbers to said adder, said number retaining means also being connected to said adder, said adder having an output connected to said comparing means, output means having an output which is either a one or a zero, and means interconnecting said comparing means and said output means to control switching of said output means between one and zero to produce an output rectangular or pulse wave corresponding to a desired tone, said comparing means controlling the time periods during which said output means is either a one or a zero and thus affording control of pulse length with time.

2. A tone generating circuits set forth in claim 1 wherein said memory comprises a ROM.

3. A tone generating circuit as set forth in claim 2 wherein said ROM comprises a PROM.

4. A tone generating circuit as set forth in claim 1 wherein said number retaining means comprises a buffer.

5. A tone generating circuit as set forth in claim 4 wherein said buffer comprises a latch.

6. A tone generating circuit as set forth in claim 2 wherein said number retaining means comprises a buffer.

7. A tone generating circuit as set forth in claim 6 wherein said buffer comprises a latch.

8. A tone generating circuit as set forth in claim 1 wherein said output means comprises a flip-flop.

9. A tone generating circuit as set forth in claim 8 wherein the flip-flop comprises a JK flip-flop.

10. A tone generating circuit as set forth in claim 1 and further including a counter, and wherein the means for providing the first mentioned sequence of digital numbers is connected to said counter and the sequence is related to the count of said counter.

11. A tone generating circuit as set forth in claim 10 and further including digital dividing means interconnecting said counter and the means for providing the first mentioned sequence of digital numbers whereby said first mentioned sequence of digital numbers comprises a plurality of digitally related frequencies.

12. A tone generating circuit as set forth in claim 1 wherein the memory control means comprises a pair of dividers, the first of said dividers being connected to said memory to control the number of transitions and hence pulses per cycle of said output means, and the second of said dividers being connected to said memory to determine the number of variations of pulse with and position.

13. A tone generating circuit as set forth in claim 1 and further including a clock and digital logic means connected to said clock and to said comparing means for strobing said circuit.

14. A tone generating circuit as set forth in claim 13 wherein said number retaining means, said memory means and said output means are connected to said digital logic means for strobing thereby.

15. A tone generating circuit as set forth in claim 1 wherein the comparing means controls pulse positions as well as pulse length.

16. A tone generating circuit for an electronic musical instrument, comprising a memory having a plurality of digital numbers stored therein, control means connected to said memory and effective to cause said memory to present a sequence of digital numbers, output means having a single output comprising a pulse wave which is either a one or a zero, and means coacting with said memory and connected to said output means to control switching of said output means single output between one and zero to produce on said single output a rectangular or pulse wave corresponding to a desired tone, the digital numbers from said memory and said coacting means controlling the time periods during which said output means is either a one or a zero, said time periods being represented by said digital numbers from said memory and thus affording control of pulse length with time.

17. A tone generating circuit as set forth in claim 15 wherein pulse position is controlled as well as pulse length.

18. A tone generating circuit for an electronic musical instrument, comprising a counter, means including a sequence of binary dividers connected to said counter for providing a sequence of binary related frequencies related to the count of said counter, means connected to said frequency providing means for retaining selected ones of said frequencies as binary numbers, number comparing means connected to said sequence providing means, a memory having a plurality of binary numbers stored therein, an adder, control means connected to said memory and effective to cause said memory to present a second sequence of binary numbers to said adder, said retaining means also being connected to said adder, said adder having an output connected to said comparing means, output means having an output which is either a one or a zero, and means interconnecting said comparing means and said output means to control switching of said output means between one and zero to produce an output rectangular or pulse wave corresponding to a desired tone, the comparing means controlling the time periods during which said output means is either a one or a zero and thus affording control of pulse length with time.

19. A tone generating circuit as set forth in claim 18 and further including a clock controlled by said counter, and digital logic means controlled by said clock and said comparing means for strobing said circuit.

20. A tone generating circuit as set forth in claim 19 and further including means connecting said digital logic means to said retaining means, said control means and said output means for strobing thereof.

21. A tone generating circuit for an electronic musical instrument, comprising a memory having a plurality of digital numbers stored therein, control means connected to said memory and effective to cause said memory to present a sequence of digital numbers, output means having an output which is either a one or a zero, and means coacting with said memory and connected to said output means to control switching of said output means between one and zero to produce an output rectangular or pulse wave corresponding to a desired tone, the digital numbers from said memory and said coacting means controlling the time periods during which said output means is either a one or a zero and thus affording control of pulse length with time, said control means comprising a first divider, means for driving said first divider, means connecting said first divider to said memory to control the number of transitions and hence pulses per cycle of said output wave, second divider means, means connecting said first divider means to said second divider means to drive said second divider means, and means connecting said second divider means to said memory to determine the number of variations of pulse length with and position.

22. A tone generating circuit as set forth in claim 21 wherein said means connecting the first divider means to said second divider means comprises an additional divider.

23. A tone generating circuit as set forth in claim 21 wherein said means connecting the first divider means to the second divider means comprises a one-shot circuit.

24. A tone generating circuit as set forth in claim 21 wherein said means connecting the first divider means to the second divider means includes a lock-out circuit.

25. A tone generating circuit as set forth in claim 12 and further including means connecting the first divider and second divider comprising an additional divider.

26. A tone generating circuit as set forth in claim 12 and further including means connecting the first divider to the second divider comprising a one-shot circuit.

27. A tone generating circuit as set forth in claim 12 and further including means connecting the first divider to the second divider comprising a lock-out circuit.

* * * * *